US008892023B2

(12) United States Patent
Kawanago et al.

(10) Patent No.: US 8,892,023 B2
(45) Date of Patent: Nov. 18, 2014

(54) IMAGE FORMING APPARATUS WITH WIDTH-WISE SHEET SHIFTING MECHANISM

(71) Applicants: Yusuke Kawanago, Tokyo (JP); Takahiro Okubo, Tokyo (JP); Masahiro Matsuo, Tokyo (JP); Yoshiteru Kawakami, Tokyo (JP); Haruki Motegi, Tokyo (JP); Osamu Yoshimura, Aichi (JP); Kunihiro Kawachi, Tokyo (JP); Ken Nonaka, Tokyo (JP)

(72) Inventors: Yusuke Kawanago, Tokyo (JP); Takahiro Okubo, Tokyo (JP); Masahiro Matsuo, Tokyo (JP); Yoshiteru Kawakami, Tokyo (JP); Haruki Motegi, Tokyo (JP); Osamu Yoshimura, Aichi (JP); Kunihiro Kawachi, Tokyo (JP); Ken Nonaka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 49 days.

(21) Appl. No.: 13/659,339

(22) Filed: Oct. 24, 2012

(65) Prior Publication Data

US 2013/0108283 A1 May 2, 2013

(30) Foreign Application Priority Data

Oct. 27, 2011 (JP) ..... 2011-235964

(51) Int. Cl.
*G03G 15/00* (2006.01)
*B65H 7/02* (2006.01)
*G03G 15/01* (2006.01)

(52) U.S. Cl.
CPC ..... *G03G 15/0189* (2013.01); *G03G 15/6561* (2013.01)
USPC ..... 399/394; 271/228; 271/265.01

(58) Field of Classification Search
CPC ..... G03G 15/6561; G03G 15/6567; G03G 2215/00721; G03G 2215/00405; G03G 2215/00561; B65H 2301/3613; B65H 2701/1315; B65H 9/002; B41J 13/26; B41J 13/30; B41J 13/32
USPC ..... 399/16, 394, 388; 271/226–228, 265.01
See application file for complete search history.

(56) References Cited

U.S. PATENT DOCUMENTS

| | | | | |
|---|---|---|---|---|
| 8,204,427 | B2 * | 6/2012 | Yamamoto et al. | 399/388 |
| 2008/0003031 | A1 * | 1/2008 | Tsuchiya et al. | 399/361 |
| 2009/0317114 | A1 * | 12/2009 | Uchida et al. | 399/68 |

FOREIGN PATENT DOCUMENTS

| | | | |
|---|---|---|---|
| JP | 2007-022680 | | 2/2007 |
| JP | 2010215374 A | * | 9/2010 |

* cited by examiner

*Primary Examiner* — Matthew G Marini
*Assistant Examiner* — Justin Olamit
(74) *Attorney, Agent, or Firm* — Lucas & Mercanti, LLP

(57) ABSTRACT

An image forming apparatus acquires an amount of deflection of the transporting sheet from a reference position thereof and calculates a required shift amount of the sheet. It determines whether or not the sheet is shifted frontward. If so, the image forming apparatus acquires a second specified shift value which is determined based on an urging force and the required shift amount using a second correction equation. Alternatively, if the sheet is shifted backward, the image forming apparatus acquires a first specified shift value which is determined based on the urging force and the required shift amount using a first correction equation. The image forming apparatus performs a registration roller shift correction based on the acquired first or second specified shift value.

4 Claims, 10 Drawing Sheets

FIG.9A

TB1

| ΔX / PAPER WEIGHT | 0～1 | 1～3 | 3～5 |
|---|---|---|---|
| 200g/m² | −0.1 | −0.3 | −0.5 |
| 100g/m² | −0.2 | −0.4 | −0.6 |
| | −0.3 | −0.5 | −0.7 |

FIG.9B

TB2

| ΔX / PAPER WEIGHT | 0～1 | 1～3 | 3～5 |
|---|---|---|---|
| 200g/m² | −0.3 | −0.5 | −1.1 |
| 100g/m² | −0.4 | −0.8 | −1.2 |
| | −0.5 | −0.9 | −1.3 |

IMAGE FORMING APPARATUS WITH WIDTH-WISE SHEET SHIFTING MECHANISM

CROSS REFERENCE TO RELATED APPLICATION

The present invention is based on Japanese Patent Application No. 2011-235964 filed with Japanese Patent Office on Oct. 27, 2011, the entire contents of which being hereby incorporated by reference.

BACKGROUND OF THE INVENTION

1. Field of the Invention

The present invention relates to an image forming apparatus for shifting a sheet along a sheet width direction that is perpendicular to a sheet transporting direction before the sheet is transported at an image-forming position with the sheet being nipped.

2. Description of Related Art

An image forming apparatus having multiple functions which have functions of a printer, a scanner, a copier, a facsimile and the like combined together has been widely used in recent years. In the image forming apparatus, there may be a deflection in which when transporting the sheet from a paper feeder or a reversing path to a secondary transfer unit during a period of image-forming time, the sheet is deflected to a direction (hereinafter, also referred to as "sheet width direction") perpendicular to a sheet-transporting direction of the sheet because of any mechanical factors in the apparatus. As the mechanical factors in the apparatus, for example, any errors in manufacturing the rollers and/or any wear on long-term deterioration are illustrated. When performing a printing operation while there is such a deflection of the sheet, an image is printed on the sheet while it is deflected from an image forming position thereof.

In order to align the image and the image forming position of the sheet accurately by taking the deflection of the sheet into consideration, a registration roller shift correction is carried out by which the deflection of the sheet can be corrected by shifting the sheet to the sheet width direction with the registration roller nipping the sheet. For example, Japanese Patent Application Publication No. 2007-22680 has disclosed an image forming apparatus in which a registration roller is arranged at an upstream side from an image forming position and a line sensor is arranged at a downstream side of the registration roller as well as the deflection of the sheet can be corrected by shifting the sheet to the sheet width direction based on the deflection amount of the sheet detected by the line sensor.

Here, the following will describe a configuration of a general shift mechanism for shifting the sheet using the registration roller. FIG. 1 shows an outline configuration example of an important portion of such a general shift mechanism 300, which is seen from a side thereof. As shown in FIG. 1, a driving roller 32 constituting the registration roller 30 is provided with a shift mechanism 300 for shifting the registration roller 30 to a sheet width direction D2. The shift mechanism 300 contains a rack 302 attached to an end of the driving roller 32, a round pinion 304 that is arranged to engage with the teeth 302*a* formed on a side surface portion of the rack 302 and a motor, not shown, that drives the pinion 304 to rotate.

When driving the motor, the pinion 304 rotates. The driving roller 32 fixed on the rack 302 is then shifted by rotation of this pinion 304 to the sheet width direction D2. The rack 302 is biased under any predetermined urging force F by a spring 306 to a front side (frontward direction) of the image forming apparatus to maintain the shift of the registration roller suitably. The registration roller 30 stays at a home position HP thereof under normal conditions in which the registration roller 30 is not shifted.

SUMMARY OF THE INVENTION

In such a registration roller shift correction, however, when performing the registration roller shift correction, shift amounts of the sheet are differently measured based on shift directions of the sheet if the registration roller 30 is shifted backward beyond the home position HP of the registration roller 30 or if the registration roller 30 is shifted frontward from the home position HP of the registration roller 30. This is because the registration roller 30 is biased by the spring 306 against a side thereof (for example, a frontward side thereof) to shift the registration roller 30 stably.

FIG. 2 shows an example of a past relationship between a specified value of the shift amount of the sheet and an actually measured value thereof at a period of time of the registration roller shift correction. In FIG. 2, a horizontal axis indicates to the specified value of the shift amount of the sheet and a vertical axis indicates to the actually measured value of the shift amount of the sheet. Right upper region indicates to a case where the sheet is shifted backward beyond the home position HP and left lower region indicates to a case where the sheet is shifted frontward before the home position HP.

As shown in FIG. 2, for example, if the sheet P is shifted backward when setting the specified value of the shift amount of the sheet as 2 mm, the actually measured value becomes 2.3 mm as shown by dotted line of FIG. 2. Further, if the sheet P is shifted frontward when setting the specified value of the shift amount of the sheet as 2 mm, the actually measured value becomes 3 mm as shown by dotted line of FIG. 2. Thus, even if the same shift amount of the sheet is set as the specified values of the shift amount of the sheet, the shift amounts of the sheet are differently measured under any influence by the spring 306 when the registration roller 30 is shifted backward or the registration roller 30 is shifted frontward. In order to make the actually measured shift amounts of the sheet P identical to each other, for example, 2 mm when the registration roller 30 is shifted backward and the registration roller 30 is shifted frontward, it is required to set the specified value as 1.7 mm when the registration roller 30 is shifted backward and to set the specified value as 1.3 mm when the registration roller 30 is shifted frontward, as shown by alternate short and long dash line of FIG. 2. A registration roller shirt correction taken the shift direction into consideration, however, has not been carried out in the past. As a result thereof, the sheet is not shitted according to the value specified by a user, particularly, frontward before or backward beyond the home position HP of the registration roller so that the shifted sheet P may be deflected from its image-forming position to fail in forming an image on the shifted sheet with high accuracy.

This invention addresses the above-mentioned issue and has an object to provide an improved image forming apparatus which may carry out a registration roller shift correction with high accuracy with taking a shift direction into consideration.

To achieve the above-mentioned object, an image forming apparatus reflecting one aspect of the present invention contains an image-forming portion that forms an image on a sheet, a detecting unit that detects an amount of deflection of the sheet from a previously set reference position along a sheet width direction which is perpendicular to a transporting direction of the sheet, the detecting unit being positioned at an upstream side of the image-forming portion, a registration roller that is biased to one side of the sheet width direction by a predetermined urging force to shift toward the sheet width direction, the registration roller being positioned at an upstream side of the detection unit, and a control unit that is configured to determine a required shift amount of the sheet on which the sheet is shifted to the reference position based on the amount of deflection of the sheet detected by the detecting unit and to control the registration roller to perform first and second registration roller shift corrections, to shift the sheet toward she sheet width direction based on the required shift amount of the sheet and to send the shifted sheet to the image-forming portion, wherein the control unit is also configured to perform the first registration roller shift correction on a first required shift amount of she sheet when shifting the sheer to a first direction on the sheet width direction to acquire a first specified shift value that takes into consideration the urging force by which the registration roller is biased or to perform the second registration roller shift correction, which is different from the first registration roller shift correction, on a second required shift amount of the sheet when shifting one sheet to a second direction on the sheet width direction, the second direction being opposed to the first direction, to acquire a second specified shift value that takes into consideration the urging force by which the registration roller is biased.

It is desirable to provide the image forming apparatus wherein the control unit is configured to acquire the first specified shift value from the first required shift amount of the sheet using a first correction equation in which the first required shift amount of the sheet based on the amount of deflection corresponds to the first specified shift value that takes into consideration the urging force when shifting the sheet to the first direction on the sheet width direction, or the control unit is configured to acquire the second specified shift value from the second required shift amount of the sheer using a second correction equation in which the second required shift amount of the sheet based on the amount of deflection corresponds to the second specified shift value that takes into consideration the urging force when shifting the sheet to the second direction on one sheet width direction.

It is also desirable to provide the image forming apparatus further containing a driving unit that shifts the registration roller to the sheet width direction, wherein the driving unit includes a stepping motor, and wherein the first and second specified values are respectively converted to a pulse signal supplied to the stepping motor.

It is further desirable to provide the image forming apparatus further containing a first shift table in which the first required shift amount of the sheet corresponds to a correction value for correcting the first required shift amount that is set by taking into consideration the urging force when shifting the sheet to the first direction, and a second shift table in which the second required shift amount of the sheet corresponds to a correction value for correcting the second required shift amount that is set by taking into consideration the urging force when shifting the sheet to the second direction, wherein the control unit is configured to acquire the first specified shift value from the first required shift amount of the sheet using the first shift table when shifting the sheet to the first direction on the sheet width direction, or the control unit is configured to acquire the second specified shift value from the second required shift amount of the sheet using the second shift table when shifting the sheet to the second direction on the sheet width direction.

It is additionally desirable to provide the image forming apparatus further containing a manipulation unit for changing any of the first and second specified shift values.

It is still further desirable to provide the image forming apparatus wherein the detecting unit detects an amount of deflection of the sheet which has been shifted by any of the first and second specified shift values by the registration roller, and the control unit is configured to correct any of the first and second specified shift values of a next transported sheet based on the amount of deflection of the shifted sheet, the amount of deflection being detected by the detecting unit.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

BRIEF DESCRIPTION OF THE DRAWINGS

FIGS. 9A and 9B are tables showing configuration examples of the shift tables corresponding to the shift directions, the tables being stored in a storage portion of the image forming apparatus according to a second embodiment of this invention.

DETAILED DESCRIPTION OF THE PREFERRED EMBODIMENTS

The following will describe embodiments of this invention with reference to the drawings.

1. First Embodiment

<Configuration Example of Image Forming Apparatus>

The image forming apparatus 100 according to the first embodiment of this invention acquires an amount of deflection $\Delta x$ from a reference position La of a sheet P, which a sheet-detecting portion (detecting unit) 70 has been detected. The image forming apparatus 100 calculates a specified shift value for shifting the sheet P to the reference position La based on the amount of deflection Δx and corrects the calculated specified shift value using a previously set correction equation according to any shift direction of the sheet P to perform a registration roller shift correction with any urging force F which urges a registration roller 30 being taken into consideration.

Figure 3:
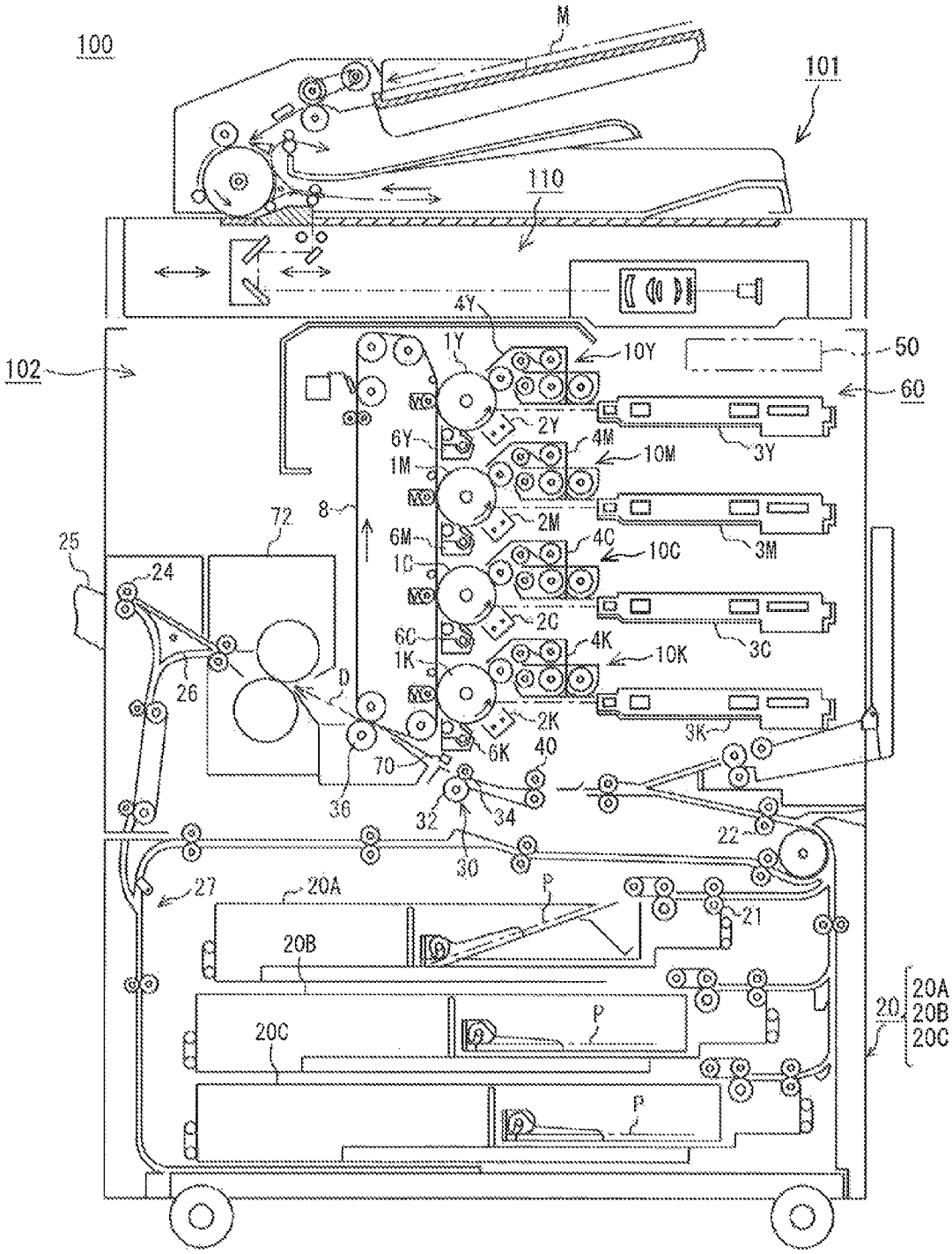
FIG. 3 is a diagram showing a configuration example of an image forming apparatus according to a first embodiment of the invention.

FIG. 3 shows a configuration example of the image forming apparatus 100 according to the first embodiment of the invention. It is to be noted that dimensions and/or ratios in the drawings are exaggerated for convenience of explanation and they may be different from actual ones. As shown in FIG. 3, the image forming apparatus 100 is an image forming apparatus of tandem type and is provided with an automatic document feeder 101 and an image forming apparatus body 102. The automatic document feeder 101 is arranged on the image forming apparatus body 102 and feeds a manuscript M set on a manuscript holder to an image-scanning portion 82 in the image forming apparatus body 102 by a transporting roller or the like.

The image forming apparatus body 102 contains the image-scanning portion 82, an image-forming portion 60, an intermediate transfer belt 8 and a fixing portion 72. The image-scanning portion 82 scans and exposes the manuscript mounted on the manuscript holder using an optical system of a scanning and exposure apparatus and reads an image on the scanned manuscript using a charge coupled device (CCD) image sensor to perform a photoelectric conversion so that an image information signal is generated. An image processing section, not shown, performs analog processing, analog/digital conversion processing (hereinafter, referred to as "A/D conversion processing"), shading processing, image compression processing and the like on the image information signal and then outputs it to the image-forming portion 60.

The image-forming portion 60 forms the image by an electrophotography method and contains an image-forming unit 10Y which forms a yellow image (Y), an image-forming unit 10M which forms a magenta image (M), an image-forming unit 10C which forms a cyan image (C) and an image-forming unit 10K which forms a black image (K). In this embodiment, the common functions concerning colors are indicated by Y, M, C and K, which respectively show colors to be formed, following a number, for example, 10.

The image-forming unit 10Y contains a photosensitive drum 1Y, a charging portion 2Y which is arranged around the photosensitive drum 1Y, an exposing (optically writing) portion 3Y, a developing portion 4Y and a cleaning portion 6Y.

The image-forming unit 10M contains a photosensitive drum 1M, a charging portion 2M which is arranged around the photosensitive drum 1M, an exposing portion 3M, a developing portion 4M and a cleaning portion 6M.

The image-forming unit 10C contains a photosensitive drum 1C, a charging portion 2C which is arranged around the photosensitive drum 1C, an exposing portion 3C, a developing portion 4C and a cleaning portion 6C.

The image-forming unit 10K contains a photosensitive drum 1K, a charging portion 2K which is arranged around the photosensitive drum 1K, an exposing portion 3K, a developing portion 4K and a cleaning portion 6K.

The respective photosensitive drums 1Y, 1M, 1C and 1K, the charging portions 2Y, 2M, 2C and 2K, the exposing portions 3Y, 3M, 3C and 3K, the developing portions 4Y, 4M, 4C and 4K and the cleaning portions 6Y, 6M, 6C and 6K in the image forming units 10Y, 10M, 10C and 10K have the respectively common configurations. They will be described with Y, M, C and K being omitted except for any cases in which they are required to be distinguished.

Each of the charging portions 2 charges a static charge uniformly around a surface of each of the photosensitive drums 1. Each of the exposing units 3 is composed of, for example, a laser scanning exposure device of polygon mirror type. The exposing units 3 scan the surfaces of the photosensitive drums 1 using laser beam based on the image information signal to form latent images. The developing portions 4 develop the latent images formed on the surfaces of the photosensitive drums 1 using toners. This enables toner images, which are visual images, to be formed on the photosensitive drums 1.

The intermediate transfer belt 8 is stretched across plural rollers so as to be able to run around them. By moving the intermediate transfer belt 8 when operating primary transfer rollers, the toner images formed on the photosensitive drums 1 are transferred to image transfer positions of the intermediate transfer belt 8 (Primary Transfer).

A paper feeder 20 is provided with plural feeding trays 20A, 20B and 20C, which respectively contain sheets P each having a predetermined size, for example, A3 or A4. The paper feeder 20 feeds the sheet P from any of the feeding trays 20A, 20B and 20C using transporting rollers 21, 22 and the like to the registration roller 30, which is arranged at a downstream side along a transporting direction of the sheet, through the loop forming roller 40. It is to be noted that numbers of the feeding trays are not limited to three. If necessary, a single or plural large capacity feeder(s) that can contain a large number of sheets P may be arranged.

The registration roller 30 has a pair of driving roller 32 and driven roller 34 and forms a loop when a leading edge of the sheet P is hit against the registration roller 30 by the loop forming roller 40 so that the sheet P can be deskewed. Further, the registration roller 30 nips the sheet P and shifts it to a sheet width direction D2 based on a detection result of the sheet-detecting portion 70 to correct the deflection of the sheet P (registration roller shift correction). In this moment, a control unit corrects specified values of the shift amount of the sheet P according to the shift direction of the sheet P based on the amount of the deflection Δx detected by the sheet-detecting portion 70 using any correction equations, which are set according to the shift direction of the sheet P. The correction equations will be described later.

When the registration roller shift correction is complete, the sheet P is transported to a secondary transfer unit 36 at a predetermined timing. The secondary transfer unit 36 transfers all of the toner images which have been transferred to the image transfer positions of the intermediate transfer belt 8, on a surface of the sheet P transported from the paper feeder 20 to form a color image (Secondary Transfer). The sheet P on which the secondary transfer is performed is transported to the fixing portion 72.

The fixing portion 72 fixes the color image on the sheet P by heating and pressing the sheet P to which the color image is transferred. The sheet P on which the fixing portion 72 has fixed is ejected by a paper election tray 25 through paper ejection roller 24.

Further, the image forming apparatus 100 is provided with a sheet-reversing unit 27 for performing a duplex printing or the like. When a duplex printing mode is set, the image forming apparatus 100 leads the sheet P which the fixing portion 72 has fixed to the sheet-reversing unit 27 and then reverses a surface thereof to be again transported to the secondary transfer unit 36 where a color image or the like is formed on a back surface of the sheet P.

[Configuration Example of Registration Roller and Sheet-Detecting Portion]

Figure 4:
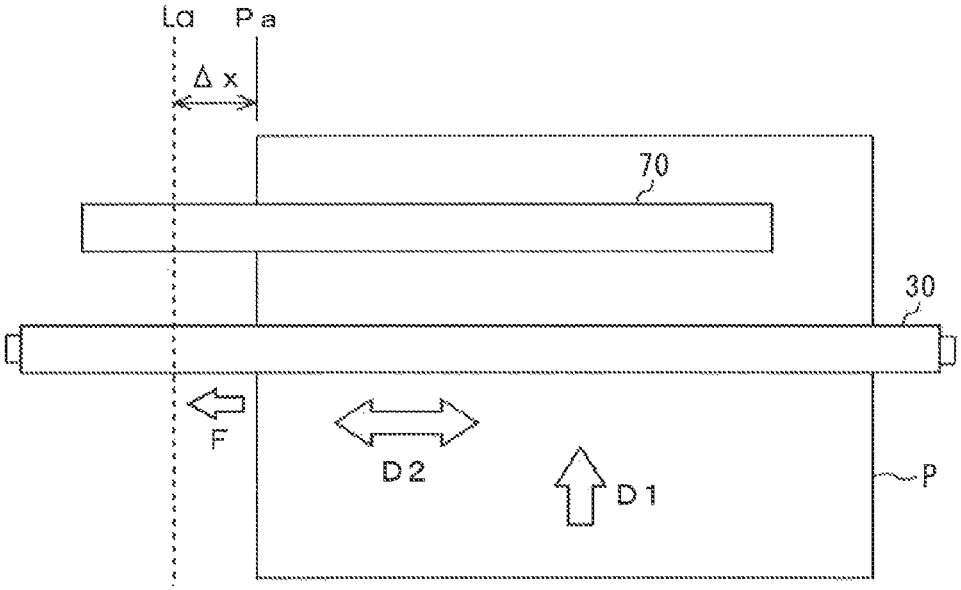
FIG. 4 is a diagram showing a relationship between a sheet and a sheet-detecting portion when calculating an amount of deflection of the sheet from a reference position thereof.

FIG. 4 shows a configuration example of the registration roller 30 and the sheet-detecting portion 70 and a relationship between the sheet P and the sheet-detecting portion 70 when a controller 50 calculates the amount of deflection Δx of the sheet P from a reference position La thereof. In this image forming apparatus 100, as shown in FIG. 4, the reference position La of the sheet P is set as a reference position when forming an image on the sheet P. In this embodiment, the sheet p is transported so that a left side end Pa of the sheet P on the sheet width direction D2 of the sheet P is passed through the reference position La of the sheet P. It is to be noted that the reference position La of the sheet P is set so that it varies for every sheet having different sizes.

The sheet-detecting portion 70 is arranged at a downstream side of the registration roller 30 along the transporting direction D1 of the sheet P. The sheet-detecting portion 70 is positioned so that a longitudinal direction thereof is parallel with the sheet width direction D2. The sheet-detecting portion 70 is composed of a line sensor in which photoelectric transducers are arranged in a row or an image sensor in which photoelectric transducers are arranged in a matrix state.

The sheet-detecting portion 70 detects the left side end of the passing sheet P and acquires as the amount of deflection Δx a distance on the sheet width direction D2 between the detected left side end Pa of the sheet P and the reference position La of the sheet P. In this embodiment, a sign of the amount of deflection Δx of the sheet P when the left side end Pa of the sheet P is deflected to a right side of the transporting direction D1 of the sheet P from the reference position La thereof is defined as plus, "+". Conversely, a sign of the amount of deflection Δx of the sheet P when the left side end Pa of the sheet P is deflected to a left side of the transporting direction D1 of the sheet P from the reference position La thereof is defined as minus, "−".

Figure 1:
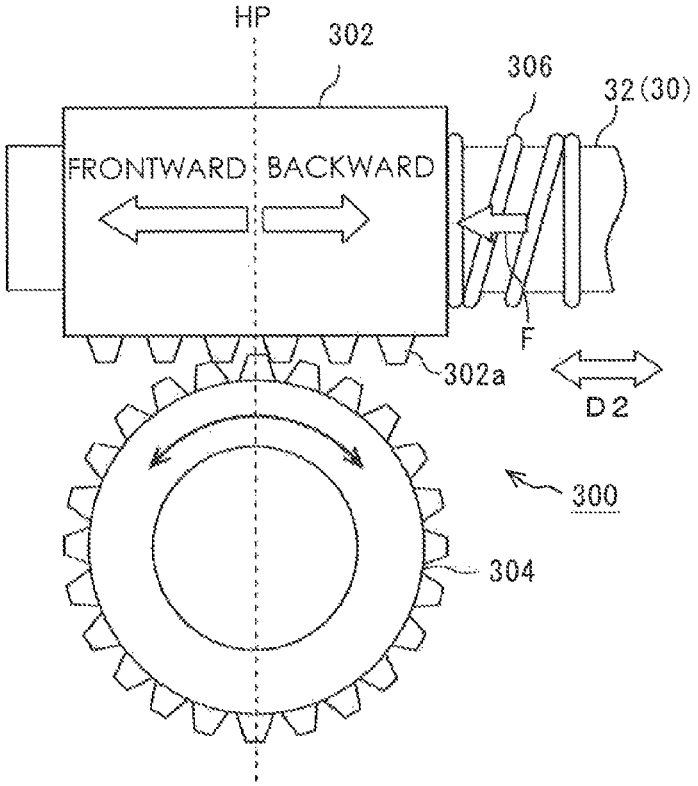
FIG.1 RELATED ART
FIG. 1 is a diagram showing an outline configuration example of an important portion of a general shift mechanism of registration roller, which is seen from a side thereof.
Figure 2:
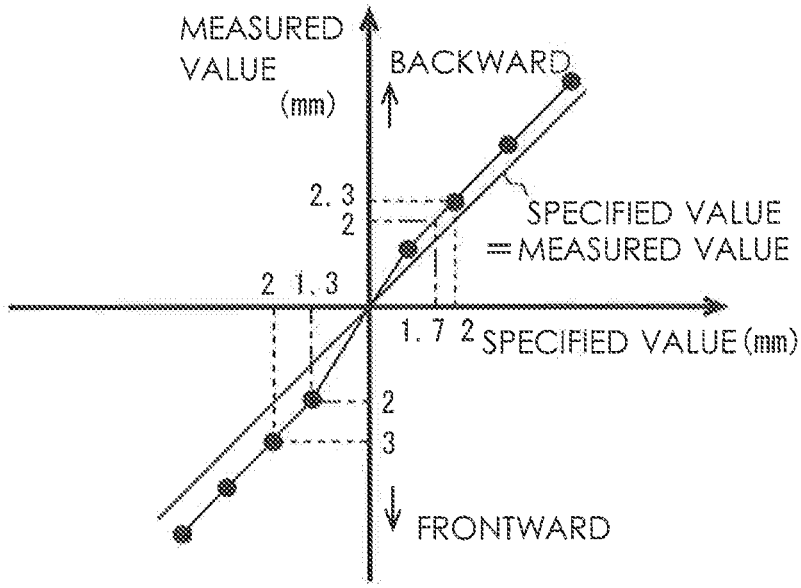
FIG.2 RELATED ART
FIG. 2 is a graph showing an example of a past relationship between a specified value of the shift amount of the sheet and an actually measured value of the shift amount of the sheet at a period of time of the registration roller shift correction.

The registration roller 30 is positioned at an upstream side of the sheet-detecting portion 70 on the transporting direction of the sheet D1. A rotation axis of the registration roller 30 is arranged so as to be parallel with the sheet-width direction D2. This registration roller 30 stays at a home position HP shown in FIG. 1 unless the registration roller shift correction is performed. In this embodiment, the home position HP is set as the reference position La of the sheet P, for example, at a part of an outer side of the registration roller 30. The registration roller 30 shifts along the sheet-width direction D2 from the home position HP. In this embodiment, the right side from the home position HP on the sheet-width direction D2 is defined as backward or plus, "+". Conversely, the left side from the home position HP on the sheet-width direction D2 is defined as frontward (a front side of the image-forming apparatus 100) or minus, "−". It is to be noted that the backward direction corresponds to a first direction on the sheet-width direction D2 while the frontward direction corresponds to a second direction on the sheet-width direction D2.

The registration roller 30 is always biased to the frontward direction on the sheet-width direction D2 by a predetermined urging force F of a spring 306 to shift the sheet P toward the sheet width direction D2 stably. Thus, even if the same shift value is specified in the backward direction and the frontward direction, when the registration roller 30 is shifted to the frontward direction, the spring 306 biases the registration roller 30 by the urging force F thereof stronger than a case where the registration roller 30 is shifted to the backward direction so that the registration roller 30 is slightly more shifted to the frontward direction. Accordingly, in this embodiment, by correcting the specified shift value using correction equations set according to the shift directions, a shift amount of the sheet P is adjusted by taking into consideration the urging force F by the spring 306.

[Block Configuration Example of Image-Forming Apparatus]

Figure 5:
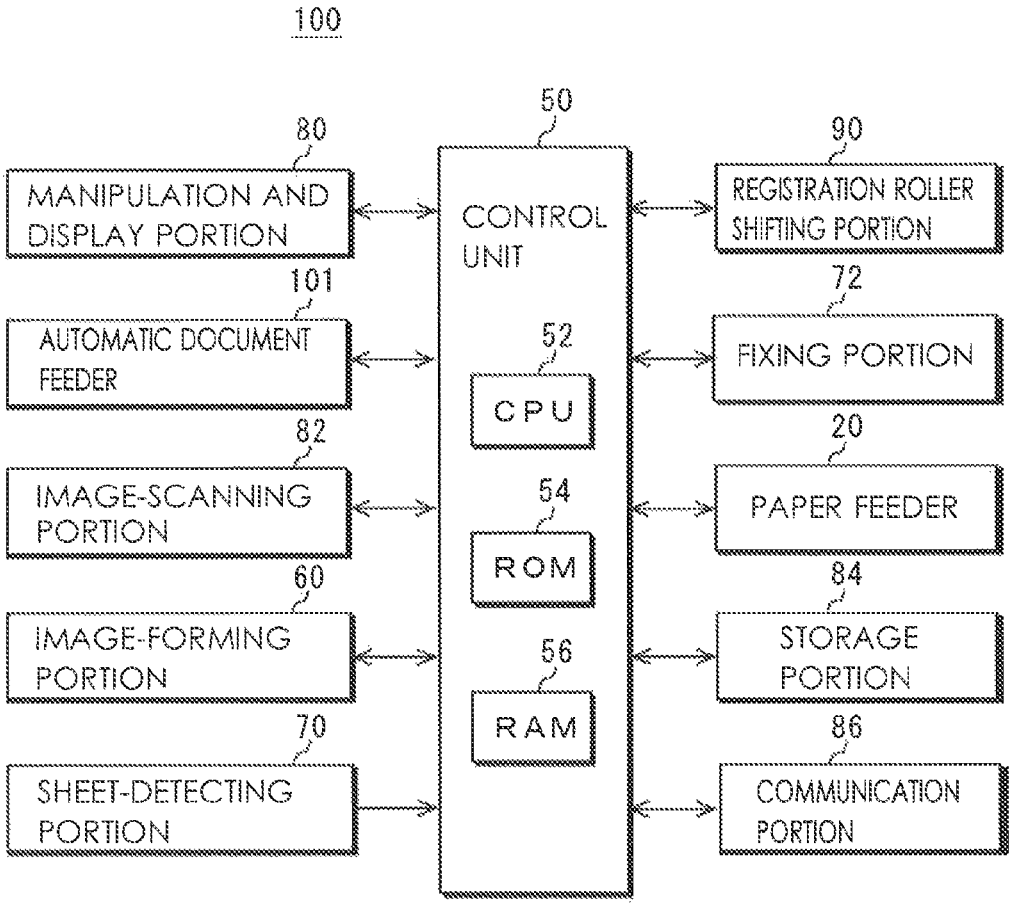
FIG. 5 is a block diagram of the image forming apparatus for showing a configuration example thereof.

FIG. 5 illustrates a block configuration example of the image forming apparatus 100. As shown in FIG. 5, the image forming apparatus 100 contains a control unit 50 controlling an operation of whole of the image forming apparatus 100. The control unit 50 includes, for example, a central processing unit (CPU) 52, a read only memory (ROM) 54 and a random access memory (RAM) 56. The CPU 52 performs an image forming process and/or a registration roller shift correction process by reading any desired programs stored in the ROM 54 and extracting the programs in the RAM 54 to execute them.

The control unit 50 connects a manipulation and display portion 80, the automatic document feeder 101, the image-scanning portion 82, the image-forming portion 60, the sheet-detecting portion 70, a registration roller shifting portion 90, the fixing portion 72, the paper feeder 20, a storage portion 84 and a communication portion 86, respectively through a bus.

The manipulation and display portion 80 is configured to have a touch panel in which a location input device of electrostatic system or resistive film system and a display device such as a liquid crystal display panel or an organic electroluminescence (EL) display panel are combined. The manipulation and display portion 80 detects any input information, based on the user's input operation and supplies a manipulation signal to the control unit 50. For example, the manipulation and display section 80 inputs various kinds of conditions input by the user when performing the image forming process such as paper weight of the sheet P, size of the sheet P. The manipulation and display section 80 inputs any information on an inclination, an intercept and the like to set or change a correction equation in the registration roller shift correction. The manipulation and display portion 80 supplies a manipulation signal based on the input information to the control unit 50.

The storage portion 84 is configured to include a semiconductor memory, a hard disk drive (HDD) and the like. The storage portion 84 stores any information on a correction equation 1 or a correction equation 2, which are used when performing the registration roller shift correction, a program for carrying out these correction equations and the like. The above-mentioned information on a correction equation 1 or a correction equation 2 may be stored in the ROM 54. It is to be noted that the correction equation 1 corresponds to a first correction equation and the correction equation 2 corresponds to a second correction equation.

The registration roller shifting portion 90 is configured to include a stepping motor. The registration roller shifting portion 90 shifts the registration roller 30 to the sheet-width direction D2 by rotating the motor based on a driving signal (specified shift value) corresponding to the amount of deflection Δx, which is supplied from the control unit 50 when performing the registration roller shift correction. The specified shift value is converted to a pulse signal formed on the basis of the amount of deflection Δx. This allows the sheet P to be shifted to the sheet-width, direction D2, thereby correcting the deflection of the sheet P.

The sheet-detecting portion 70 detects the amount of deflection Δx from the reference position La of a transported sheet P and supplies a manipulation signal based on the amount of deflection Δx to the control unit 50.

The image-forming portion 60 includes image forming units 10Y, 10M, 10C and 10K and performs any image forming processes based on any control information supplied from the control unit 50.

The paper feeder 20 feeds the sheet P corresponding to the information on the sheet size input by the manipulation and display portion 80 or the like from a feeding tray to the image-forming portion 60 based on the control signal supplied from the control unit 50.

The fixing portion 72 fixes a toner image to the sheet P by performing pressure and heat processing on the sheet P in which the toner images have been fixed in the image-forming portion 60.

The communication portion 86 is configured to include various kinds of interfaces such as network interface card (NIC), modulator-demodulator (MODEM) and universal serial bus (USB). The communication portion 86 communicates external equipment such as a personal computer which is connected through the communication portion 86.

[Correction Equations]

Figure 6:
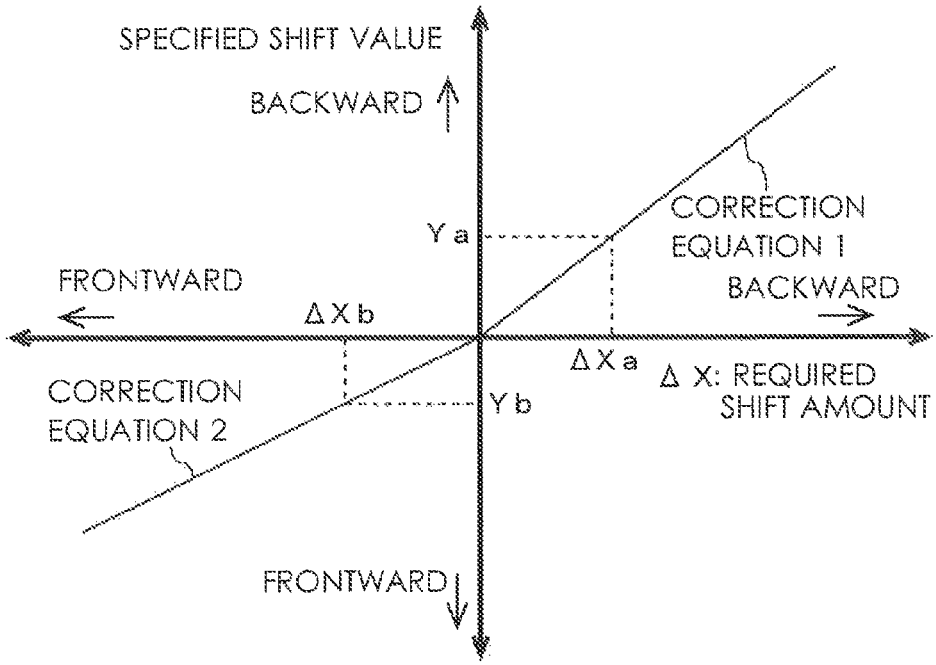
FIG. 6 is a graph showing correction equations set based on a required shift amount and a specified shift value.

The following will describe the correction equations for correcting a required shift amount of the sheet P according to the shift directions of the sheet P. FIG. 6 is a graph for explaining the correction equations for correcting a required shift amount of the sheet P. A vertical axis thereof indicates a specified shift value, which is set by taking into consideration the urging force F by the spring 306, after the correction has been performed. A horizontal axis thereof indicates a required shift amount based on the amount of the deflection Δx detected by the sheet-detecting portion 70.

As the correction equations, two different equations are defined according to the shift directions of the sheet P. These equations are a correction equation 1 and a correction equation 2. The correction equation 1 is used when shifting the sheet P to the backward side. The correction equation 2 is used when shifting the sheet P to the frontward side. For example, when the image forming apparatus 100 is manufactured, the sheet-detecting portion 70 detects the amounts of the deflection of the sheets actually. Actual measured values are acquired by performing the registration roller shift correction based on the specified shift values corresponding to the acquired amounts of the deflection of the sheets. The above equations are formed on any differences between each of the actual measured values thus acquired and each of the specified shift values.

First, the correction equation 1 used for the backward side will be described. The correction equation 1 is defined as the following equation (1).

$$Y_1=a_1\{\Delta X/(\text{a shift amount of motor/one pulse})+b_1\} \quad (1)$$

Here, $Y_1$ is a specified shift value, which is set by taking into consideration an urging force F by the spring 306, after the correction has been performed and indicates a pulse signal to be supplied to the registration roller shifting portion 90; $a_1$ is a correction coefficient, i.e., an inclination and $b_1$ is an intercept. The intercept $b_1$ is determined by a backlash in the registration roller shifting portion 90 that drives the registration roller 30, ΔX is a required shift amount (mm) corresponding to the amount of the deflection Δx detected by the sheet-detecting portion 70. The shift amount of motor per one pulse is previously set on the basis of a specification of the registration roller shifting portion 90 to be used.

For example, the control unit 50 calculates the required shift amount ΔX based on the amount of the deflection Δx detected by the sheet-detecting portion 70 when the sheet-detecting portion 70 acquires the amount of the deflection Δx from the reference position La of the sheet P. In this embodiment, the required shift amount ΔX is set as the amount of the deflection Δx. For example, if a calculated required shift amount is ΔXa, this required shift amount ΔXa is substituted for the above-mentioned equation (1) so that the specified shift value $Y_a$ can be acquired as pulse signal from the required shift amount ΔXa.

Next, the correction equation 2 used for the frontward side will be described. The correction equation 2 is defined as the following equation (2).

$$Y_2=a_2\{\Delta X/(\text{a shift amount of motor/one pulse})+b_2\} \quad (2)$$

Here, $Y_2$ is a specified shift value, which is set by taking into consideration an urging force F by the spring 306, after the correction has been performed and indicates a pulse signal to be supplied to the registration roller shifting portion 90; $a_2$ is a correction coefficient, i.e., an inclination and $b_2$ is an intercept. The intercept $b_2$ is determined by a backlash in the registration roller shifting portion 90 that drives the registration roller 30. ΔX is a required shift amount (mm) corresponding to the amount of the deflection Δx detected by the sheet-detecting portion 70. The shift amount of motor per one pulse is previously set on the basis of a specification of the registration roller shifting portion 90 to be used. For example, if a calculated required shift amount is ΔXb, this required shift amount ΔXb is substituted for the above-mentioned equation (2) so that the specified shift value $Y_b$ can be acquired as pulse signal from the required shift amount ΔXb.

In the correction equation 2, its inclination $a_2$ is set so as to be smaller than the inclination $a_1$ of the correction equation 1. This is because the registration roller 30 is biased to the frontward direction by the spring 306 and when shifting the sheet P to the frontward side, the urging force F by the spring 306 is more added to the sheet so that an amount of shift of the sheet P is increased as compared with a case where the sheet P is shifted to the backward side. Thus, in the correction equation 2, by making the inclination smaller, the specified shift value $Y_2$ is set so as to be limited by the urging force F by the spring 306. As a result thereof, the specified shift values $Y_1$ and $Y_2$ after the correction at the frontward and backward sides are identical to each other.

Here, the specified shift values $Y_1$ and $Y_2$ obtained by the correction equations 1 and 2 may include an amount of correction which is set by taking into consideration a difference between the specified shift value and the actually measured value thereof occurred by an influence of friction between the sheet P and a transporting path on which the sheet P is transported, in addition to the amount of correction for correcting an influence by the urging force F of the spring 306. In other words, as the paper weight and size of the sheet P to be used are made larger or humidity in a space of the image forming apparatus (or humidity in a room in which the image forming apparatus is settled) is made higher, the friction between the sheet P and a transporting path on which the sheet P is transported is made larger so that the difference between the specified shift value and the actually measured value thereof is relatively increased. Thus, it is possible to correct the required shift amount suitably based on the paper weight and size of the sheet P. Further, when performing duplex printing, the sheet P is flexed at a period of registration roller shift correction time so that a resistance of the sheet P is made stronger as compared with a case where a simplex printing is performed. In this case, it is also preferable to correct the required shift amount suitably. For example, frictional force is increased and the shift amount is decreased for that so that the specified shift value Y may be set by adding the shift amount by an amount of frictional force to the required shift amount.

[Configuration Example of Management Screen]

Figure 7:
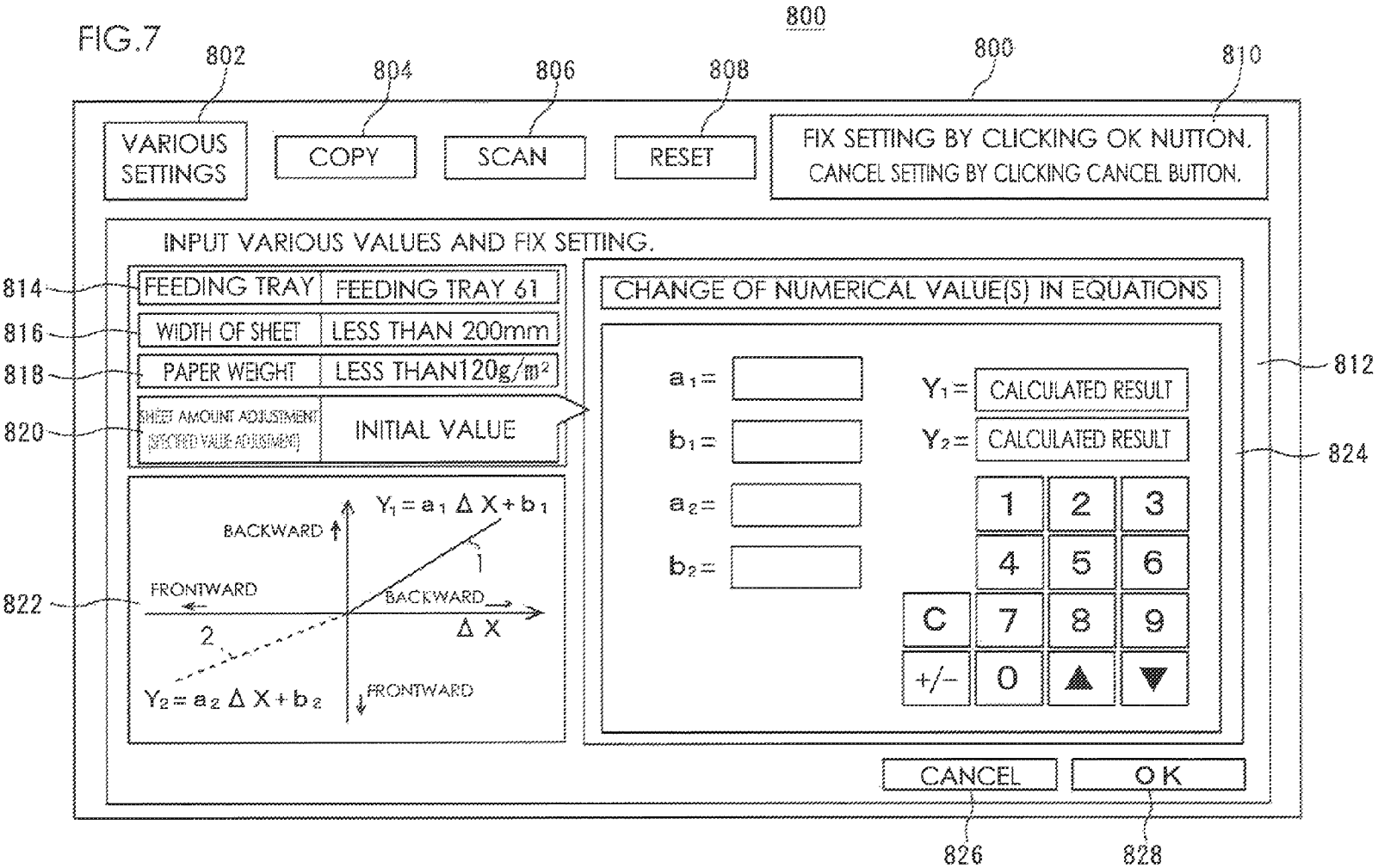
FIG. 7 is a diagram showing a configuration example of a management screen for changing a numerical value in the correction equations.

FIG. 7 shows a configuration example of a management screen 800 to be displayed on the manipulation and display portion 80 for inputting and/or changing a numerical value in the correction equations. In this embodiment, as the management screen 800, a touch panel is adapted.

As shown in FIG. 7, the management screen 800 includes a various setting button 802 for performing any basic setting on the image forming, a copy button 804 for fixing an execution of the image forming, a scan button 806 for executing a scan or facsimile, a reset button 808 for suspending a copy or a scanning or resetting all of the settings, a comment column 810 for displaying any comments for user operation aid, and a changing screen 812 for changing a situation of the sheet P and various numerical values in the correction equations 1 and 2.

The following will describe the changing screen 812. The changing screen 812 is displayed on the management screen 800 when, for example, a user selects a button for changing the numerical value in the equations after the user has selected the various setting button 802. The changing screen 812 contains a feeding tray specifying button 814, a sheet size specifying button 816, a paper weight specifying button 818, a shift amount adjustment button (specified shift value adjustment button) 820, an equation displaying screen 822, a numerical value changing screen 824, a cancel button 826, and an OK button 828. The feeding tray specifying button 814 is a button for specifying a feeding tray to be set. The sheet size specifying button 816 and the paper weight specifying button 818 are respectively buttons for setting a sheet size and a paper weight for the feeding tray specified by the feeding tray specifying button 814.

The shift amount adjustment button 820 is a button for inputting or changing the inclination $a_1$ and intercept $b_1$ of the correction equation 1 and the inclination $a_2$ and intercept $b_2$ of the correction equation 2. When the user selects the shift amount adjustment button 820, the equation displaying screen 822 and the numerical value changing screen 824 are displayed on the changing screen 812. On the numerical value changing screen 824, items of the inclination $a_1$ and intercept $b_1$ of the correction equation 1, the specified shift value $Y_1$, the inclination $a_2$ and intercept $b_2$ of the correction equation 2 and the specified shift value $Y_2$, number buttons for inputting or changing the value, up/down buttons for allowing the user to be shifted between the items and the like are displayed.

The user can set any of the correction equations by inputting the inclination and the intercept of each equation operating the number buttons and the like while seeing the equation displaying screen 822. The correction equations may be previously set when the image forming apparatus is manufactured. The user can change the numerical values of the inclination and intercept of the set correction equation based on a result of the registration roller shift correction operation. This allows an accuracy of alignment of an image and the sheet P to be improved.

[Operation Example of Image Forming Apparatus]

Figure 8:
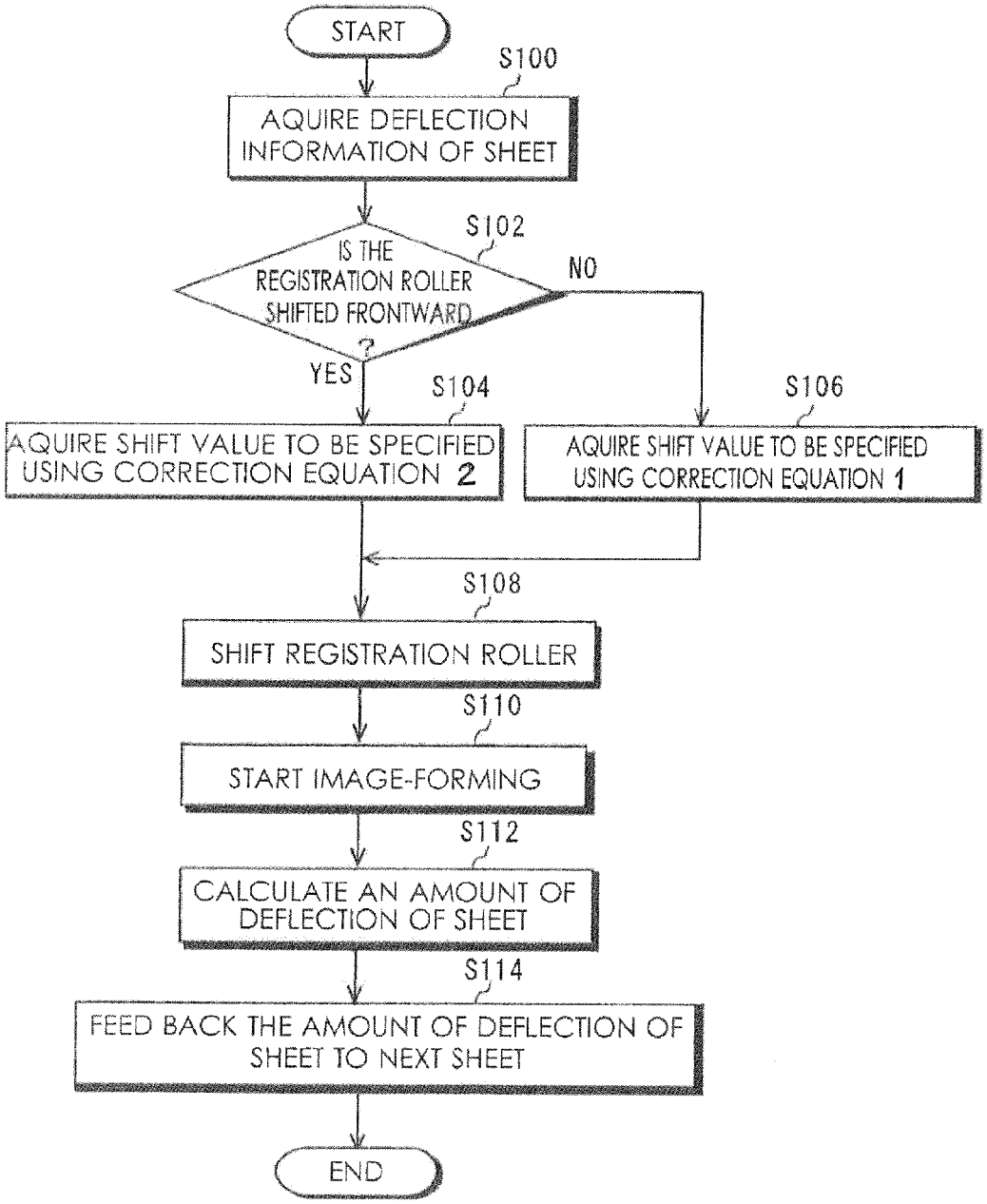
FIG. 8 is a flowchart showing an operation example of a control unit during an operation time of registration roller shift correction.

The following will describe an operation example of the control unit 50 when performing the registration roller shift correction. FIG. 8 shows the operation example of the control unit 50 of the image forming apparatus 100 when performing the registration roller shift correction.

As shown in FIG. 8, at a ST100, the control unit 50 acquires the amount of the deflection Δx from the reference position La of the sheet P, which is transported from the paper feeder 20 or a reverse transporting route, by the sheet-detecting portion 70. The control unit 50 calculates the required shift amount ΔX which is required for shifting the sheet P to the reference position La of the sheet P based on the amount of the deflection Δx acquired from the sheet-detecting portion 70. A sign "+" or "−" is added to this required shift amount ΔX according to the shift direction of registration roller. The control unit 50 goes to a step S102 after the control unit 50 has calculated the required shift amount ΔX.

At the step S102, the control unit 50 determines whether or not the shift direction of the registration roller is the frontward direction in the required shift amount ΔX thus calculated. The control unit 50 determines whether or not the shift direction of the registration roller is the frontward direction by checking that the sign added to the required shift amount ΔX is "+" or "−". The control unit 50 determines that the shift direction of the registration roller is the backward direction if the sign added to the required shift amount ΔX is "+" and then, goes to a step S106. Contrary, the control unit 50 determines that the shift direction of the registration roller is the frontward direction if the sign added to the required shift amount ΔX is "−" and then, goes to a step S104.

At the step S104, the control unit 50 reads the correction equation 2 (the above-mentioned equation (2)) corresponding to the frontward direction out of a memory in the storage portion 84 or the like. The control unit 50 then substitutes the required shift amount ΔX to the read correction equation 2 to acquire the specified shift value $Y_2$ which is set by taking into consideration the urging force F of the spring 306. This specified shift value $Y_2$ is converted to a pulse signal to be given to the registration roller shifting portion 90. When acquiring the specified shift value $Y_2$, the control unit 50 goes to a step S108.

On the other hand, at the step S106, the control unit 50 reads the correction equation 1 (the above-mentioned equation (1)) corresponding to the backward direction out of the memory in the storage portion 84 or the like. The control unit 50 then substitutes the required shift amount ΔX to the read correction equation 1 to acquire the specified shift value $Y_1$ which is set by taking into consideration the urging force F of the spring 306. This specified shift value $Y_1$ is converted to a pulse signal to be given to the registration roller shifting portion 90. When acquiring the specified shift value $Y_1$, the control unit 50 goes to the step S108.

At the step S108, the control unit 50 performs the registration roller shift correction based on the acquired specified shift value $Y_1$ or $Y_2$. For example, the registration roller 30 nips the sheet P and the specified shift value $Y_1$ or $Y_2$ (pulse signal) thus acquired is supplied to the registration roller shifting portion 90. The control unit 50 then shifts the registration roller 30 frontward or backward from its home position HP to shift the sheet P to the reference position La of the sheet P. When the registration roller shift correction in complete, the control unit 50 controls the registration roller 30 or the like to transport the sheet P to the secondary transfer unit 36. At the same time, the control unit 50 controls the registration roller 30 to release the nip of the sheet P. The control unit 50 then controls the registration roller 30 to shift to its home position HP and to bring its condition to the close condition. The control unit 50 then goes to a step S110.

At the step S110, the control unit 50 starts image forming process. The sheet P is transported to the secondary transfer unit 36 at a predetermined timing and an image which has been formed on the intermediate transfer belt 8 is transferred to the sheet P. In this moment, the deflection of the sheet P has been corrected by the registration roller shift correction so that the image can be transferred to the sheet P without any shear.

At a step S112, the control unit 50 again acquires the amount of the deflection Δx of the sheet P by the sheet-detecting portion 70. In other words, the control unit 50 acquires the amount of the deflection Δx from the reference position La of the sheet P on which the registration roller shift correction has been performed. This is because there may be a case where the deflection of the sheet P is not completely corrected even if the registration roller shift correction is performed on the sheet P. The control unit 50 goes to a step S114 when acquiring the amount of deflection Δx of the sheet P.

At the step S114, the control unit 50 calculates a correction value for feeding back the amount of deflection Δx to the next transported sheet P based on the amount of deflection Δx of the sheet P acquired by the sheet-detecting portion 70. For example, the control unit 50 calculates the amount of deflection Δx from the difference between the shift amount (specified shift amount) corresponding to the specified shift amount and the actually measured value and feeds the amount of deflection Δx thus calculated as the correction value back to the specified shift value Y of the next transported sheet P. When performing the registration roller shift correction on the next transported sheet P, the control unit 50 corrects the calculated specified shift value Y based on the correction equation using the correction value to form a pulse signal which is supplied to the registration roller shifting portion 90 to perform a registration roller shift correction on the next transported sheet P. This enables the registration roller shift correction to be carried out with high accuracy. It is to be noted that the correction equation itself may be amended on the basis of the fed-back correction value.

As described above, in the first embodiment, when performing the registration roller shift correction, the specified shift value (required shift amount) is corrected using the correction equation 1 if the registration roller 30 or the sheet P is shifted backward. The specified shift value (required shift amount) is also corrected using the correction equation 2 if the registration roller 30 or the sheet P is shifted frontward. For example, when shifting the sheet P by 2 mm, the control unit 50 forms the specified shift value $Y_1$ based on the correction equation 1 so that the shift amount on the backward direction is 1.7 mm and forms the specified shift value $Y_2$ based on the correction equation 2 so that the shift amount on the frontward direction is 1.3 mm. This enables the specified shift value Y to be adjusted with taking into consideration the urging force F (burden) on which the registration roller 30 is biased so that the shift amount can be adjusted without any deflection on the shift direction. Thus, an accuracy of the registration roller shift correction can be improved so that an image can be formed on the sheet P with high accuracy.

2. Second Embodiment

The second embodiment is different from the first embodiment in that the specified shift value is corrected using a shift table to be used for each shift direction. It is to be noted that other components and operations of the image forming apparatus according to this embodiment are identical to those of the first embodiment so that the identical components are indicated by the same reference numbers, a detailed explanation of which will be omitted.

[Configuration Example of Shift Tables]

FIGS. 9A and 9B show configuration examples of the shift tables for correcting the required shift amount (specified shift value) corresponding to the shift direction of the sheet P. FIG. 9A shows a table TB1 used when shifting the registration roller 30 (the sheet P) to the backward direction and FIG. 9B shows a table TB2 used when shifting the registration roller 30 (the sheet P) to the frontward direction. It is to be noted that the shift table TB1 corresponds to a first shift table and the shift table TB2 corresponds to a second shift table.

The storage portion 84 stores the shift table TB1 to be used when the sheet P is shifted to the backward direction and the shift table TB2 to be used when the sheet P is shifted to the frontward direction, respectively. For example, during the manufacture of the image forming apparatus 100, the sheet-detecting portion 70 actually detects the amounts of deflection Δx of plural sheets P. The control unit 50 then acquires an actually measured value of each sheet P by performing the registration roller shift correction on each sheet P based on the required shift amount ΔX corresponding to the acquired amount of deflection Δx. The shift tables TB1 and TB2 may be created on the basis of a difference between the actually measured value thus acquired and the required shift amount ΔX. It is to be noted that although, in this embodiment, the shift tables TB1 and TB2 are separately configured, they may be configured as one shift table.

The following describe the shift table TB1 for the backward direction. As shown in FIG. 9A, a row indicates the required shift amount ΔX and a column indicates paper weight of the sheet P. In this embodiment, the required shift amount ΔX is partitioned into three categories: less than 1 mm; 1 mm or more through less than 3 mm; and 3 mm or more through less than 5 mm. The paper weight is also partitioned into three categories: less than 100 g/m$^2$; 100 g/m$^2$ or more through less than 200 g/m$^2$; and 200 g/m$^2$ or more. As the correction value (shift amount (mm) required for the correction) for correcting the required shift amount ΔX, numerical values corresponding to the required shift amount ΔX and the paper weight are stored.

Here, the paper weight of the sheet P is taken into consideration because as the paper weight of the sheet P is heavier, a frictional force (guiding resistance) occurred between the sheet P and the transporting route has an effect on the difference between the specified value and the actually measured value. Particularly, as the paper weight of the sheet P is heavier, the guiding resistance by the sheet P is made larger so that the shift amount based on the specified value is indicated so as to be made smaller. Therefore, in this embodiment, as the paper weight of the sheet P is heavier, the subtracting correction value is set to be small so that the shift amount is made larger.

The following describe the shift table TB2 for the frontward direction. As shown in FIG. 9B, a row indicates the required shift amount ΔX and a column indicates paper weight of the sheet P. In this embodiment, the required shift amount ΔX is partitioned into three categories; less than 1 mm; 1 mm or more through less than 3 mm; and 3 mm or more through less than 5 mm. The paper weight is also partitioned into three categories: less than 100 g/m$^2$; 100 g/m$^2$ or more through less than 200 g/m$^2$; and 200 g/m$^2$ or more. As the correction value (shift amount (mm) required for the correction) for correcting the required shift amount ΔX, numerical values corresponding to the required shift amount ΔX and the paper weight are stored. Also, in this shift table TB2, because of the same reason as that of the shift table TB1, the subtracting correction value is set to be small as the paper weight of the sheet P is heavier, so that the shift amount is made larger.

The correction values for the shift table TB2 for the frontward direction are set so as to be larger than those for the shift table TB1 for the backward direction as a whole. This is because the registration roller 30 is biased to the frontward side by the spring 306 and when the sheet P is shifted to the frontward direction, the urging force F by the spring 306 is added to the registration roller 30 so that the shift amount of the sheet P is made larger than that shifted when the sheet P is shifted to the backward direction. Thus, for example, when the required shift amount ΔX is 2 mm and the paper weight is 150 g/m$^2$, the correction value is −0.4 mm in the shift table TB1 for the backward direction while the correction value is −0.8 mm in the shift table TB2 for the frontward direction.

[Operation Example of Image Forming Apparatus]

Figure 10:
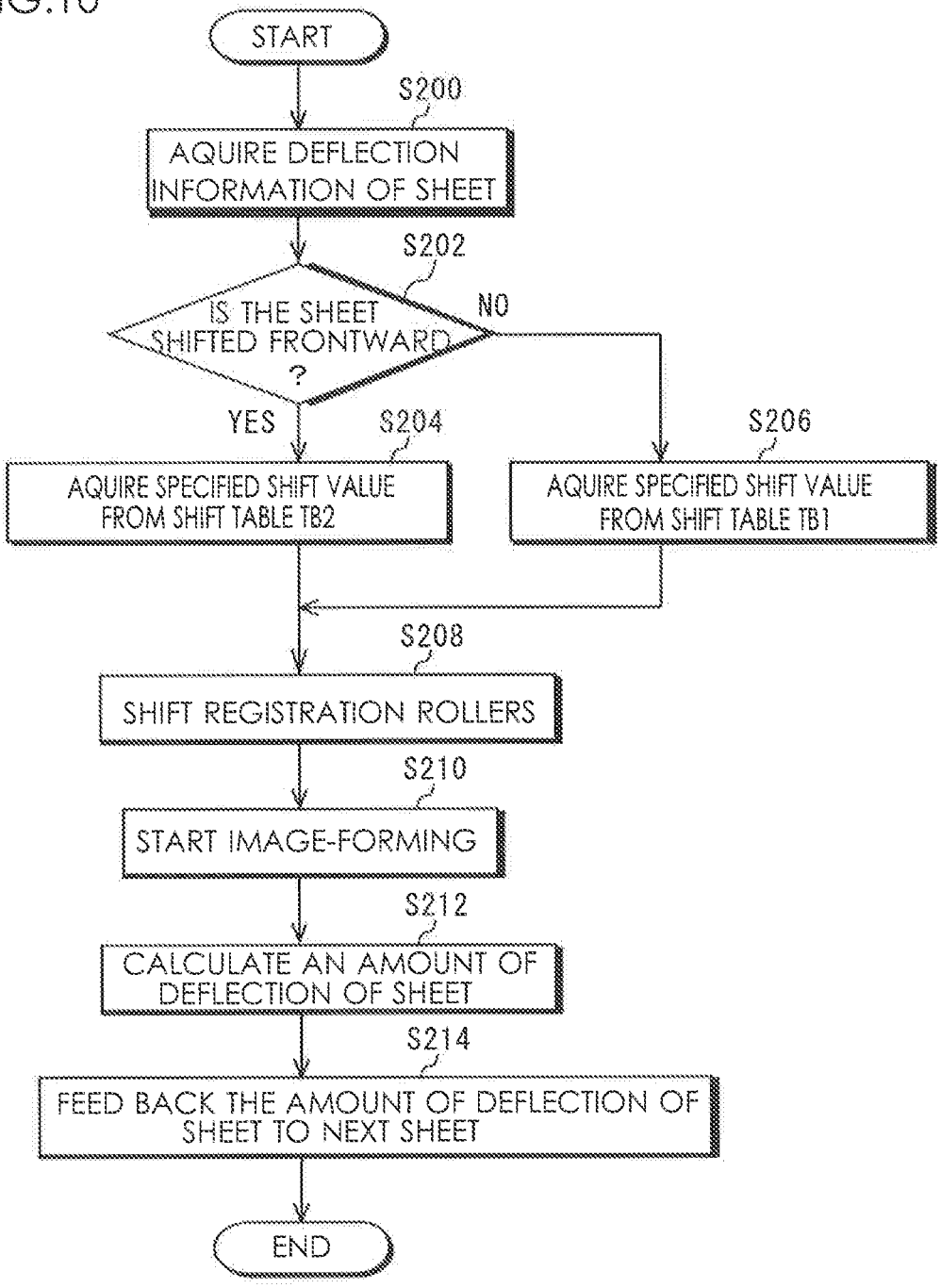
FIG. 10 is a flowchart showing an operation example of a control unit during an operation time of registration roller shift correction in the image forming apparatus according to the second embodiment of this invention.

The following will describe an operation example of the control unit 50 when performing the registration roller shift correction in this embodiment. FIG. 10 shows the operation example of the control unit 50 of the image forming apparatus 100 when performing the registration roller shift correction according to the second embodiment. It is to be noted that common operations to the operations of the control unit 50 when performing the registration roller shift correction according to the first embodiment shown in FIG. 8 will be briefly described.

As shown in FIG. 10, at a ST200, the control unit 50 acquires the amount of the deflection Δx from the reference position La of the sheet P, which is transported from the paper feeder 20 or a reverse transporting route, by the sheet-detecting portion 70. The control unit 50 calculates the required shift amount ΔX which is required for shifting the sheet P to the reference position La of the sheet P based on the amount of the deflection Δx acquired from the sheet-detecting portion 70. The control unit 50 goes to a step S202 after the control unit 50 has calculated the required shift amount ΔX.

At the step S202, the control unit 50 determines whether or not the shift direction of the registration roller is the frontward direction in the required shift amount ΔX thus calculated. The control unit 50 determines that the shift direction of the registration roller is the backward direction if the sign added to the required shift amount ΔX is "+" and then, goes to a step S206. Contrary, the control unit 50 determines that the shift direction of the registration roller is the frontward direction if the sign added to the required shift amount ΔX is "−" and then, goes to a step S204.

At the step S204, using the shift table TB2 for the frontward direction, the control unit 50 acquires the corrected specified shift value $Y_2$ which is set by taking into consideration the urging force F of the spring 306. Specifically, the control unit 50 reads the shift table TB2 out of a memory in the storage portion 84 or the like and acquires the paper weight set by the manipulation and display portion 80 out of the memory in the storage portion 84 or the like. The control unit 50 also reads the corresponding correction value from the paper weight and the required shift amount Δx by referring to the shift table TB2. The control unit 50 then subtracts the read correction value from the required shift amount ΔX to obtain the corrected shift amount and converts the corrected shift amount to a pulse signal to acquire the specified shift value $Y_2$. When acquiring the specified shift value $Y_2$, the control unit 50 goes to a step S208.

On the other hand, at the step S206, using the shift table TB1 for the backward direction, the control unit 50 acquires the corrected specified shift value $Y_1$ which is set by taking into consideration the urging force F of the spring 306. Specifically, the control unit 50 reads the shift table TB1 out of a memory in the storage portion 84 or one like and acquires the paper weight set by the manipulation and display portion 80 out of the memory in the storage portion 84 or the like. The control unit 80 also reads the corresponding correction value from the paper weight and the required shift amount ΔX by referring to the shift table TB1. The control unit 50 then subtracts the read correction value from the required shift amount ΔX to obtain the corrected shift amount and converts the corrected shift amount to a pulse signal to acquire the specified shift value $Y_1$. When acquiring the specified shift value $Y_1$, the control unit 50 goes to a step S208.

At the step S208, the control unit 50 performs the registration roller shift correction based on the calculated specified shift value $Y_1$ or $Y_2$. For example, the registration roller 30 nips the sheet P and the specified shift value $Y_1$ or $Y_2$ (pulse signal) thus calculated is supplied to the registration roller shifting portion 90. The control unit 50 then shifts the registration roller 30 frontward or backward from its home position HP to shift the sheet P to the reference position La of the sheet P. When the registration roller shift correction is complete, the control unit 50 goes to a step S210.

At the step S210, the control unit 50 starts image forming process. At a step S212, the control unit 50 again acquires the amount of the deflection Δx of the sheet P from the sheet-detecting portion 70. At the step S214, the control unit 50 calculates a correction value for feeding back the amount of deflection Δx to the next transported sheet P based on the amount of deflection Δx of the sheet P acquired from the sheet-detecting portion 70. Namely, the control unit 50 calculates the correction value for correcting the correction value in the shift tables TB1 and TB2. In this embodiment, the control unit 50 repeats such a series of operation.

As described above, in the second embodiment, when performing the registration roller shift correction, the specified shift value (required shift amount) is corrected using the shift table TB1 if the registration roller 30 or the sheet P is shifted backward. The specified shift value (required shift amount) is also corrected using the shift table TB2 if the registration roller 30 or the sheet P is shifted frontward. This enables the specified shift value (required shift amount) to be adjusted with taking into consideration the urging force F by which the registration roller 30 is biased so that the shift amount can be adjusted without any deflection on the shift direction. Thus, an accuracy of the registration roller shift correction can be improved so that an image can be formed on the sheet P with high accuracy.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

Although in the above-mentioned first embodiment, the user has changed the specified shift value obtained using the correction equations on the management screen 800 in the manipulation and display portion 80, this invention is not limited thereto. For example, the user may change the numerical value of the correction value in the shift table TB1 or TB2 on the management screen 800 in the manipulation and display portion 80 as described in the second embodiment.

Although, in the above-mentioned first embodiment, one correction equation has been used for a predetermined condition of the paper weight of the sheet P, this invention is not limited thereto. Plural correction equations may be set for every paper weight of the sheet P. Further, in addition to the paper weight of the sheet P, a size of the sheet and/or humidity in the apparatus may be applied thereto.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus comprising:

an image-forming portion that forms an image on a sheet;

a detecting unit that detects an amount and direction of deflection of the sheet from a previously set reference position along a sheet width direction which is perpendicular to a transporting direction of the sheet, the detecting unit being positioned at an upstream side of the image-forming portion;

a registration roller that is biased to one side of the sheet width direction by a predetermined urging force of a spring and that shifts along the sheet width direction, the registration roller being positioned at an upstream side of the detection unit; and a control unit that is configured to determine, based on the amount and direction of deflection of the sheet detected by the detecting unit, a first required shift amount of the sheet in a first direction or a second required shift amount of the sheet in a second direction and to control the registration roller to perform first or second registration roller shift corrections, to shift the sheet along the sheet width direction to the reference position based on the first or second required shift amounts of the sheet and to send the shifted sheet to the image-forming portion, wherein the control unit is also configured to determine a first specific shift value for the first registration roller shift correction based on the first required shift amount of the sheet when shifting the sheet in the first direction along the sheet width direction, the first specific shift value including a first amount of correction for correcting an influence by the urging force of the spring by which the registration roller is biased, or to determine a second specific shift value for the second registration roller shift correction, which is different from the first registration roller shift correction, based on the second required shift amount of the sheet when shifting the sheet in the second direction along the sheet width direction, the second specific shift value including a second amount of correction for correcting an influence by the urging force of the spring by which the registration roller is biased, wherein the first specific shift value is determined using a first correction equation which uses the first required shift amount of the sheet based on the amount of deflection and a first correction coefficient based on the urging force of the spring when shifting the sheet to the first direction in the sheet width direction, or the second specific shift value is determined using a second correction equation which uses the second required shift amount of the sheet based on the amount of deflection and a second correction coefficient constant based on the urging force of the spring when shifting the sheet to the second direction in the sheet width direction.

2. The image forming apparatus of claim 1, further comprising:

a driving unit that shifts the registration roller along the sheet width direction, wherein the driving unit includes a stepping motor; and that the first or second specific shift values are converted to a pulse signal supplied to the stepping motor.

3. The image forming apparatus of claim 1 further comprising a manipulation unit for changing any of the first and second specific shift values.

4. The image forming apparatus of claim 1, wherein the detecting unit detects an amount of deflection of the sheet which has been shifted by any of the first and second specific shift values by the registration roller, and the control unit is configured to correct any of the first and second specific shift values of a next transported sheet based on the amount of deflection of the shifted sheet, the amount of deflection being detected by the detecting unit.

* * * * *